US011460800B2

(12) United States Patent
Johnson, Jr.

(10) Patent No.: US 11,460,800 B2
(45) Date of Patent: Oct. 4, 2022

(54) SHUTTER FOR IMAGING DEVICE FUSER ASSEMBLY TRIGGERED BY CARTRIDGE

(71) Applicant: LEXMARK INTERNATIONAL, INC., Lexington, KY (US)

(72) Inventor: Virgil Johnson, Jr., Versailles, KY (US)

(73) Assignee: LEXMARK INTERNATIONAL, INC., Lexington, KY (US)

( * ) Notice: Subject to any disclaimer, the term of this patent is extended or adjusted under 35 U.S.C. 154(b) by 0 days.

(21) Appl. No.: 17/501,214

(22) Filed: Oct. 14, 2021

(65) Prior Publication Data

US 2022/0066382 A1 Mar. 3, 2022

Related U.S. Application Data

(63) Continuation of application No. 17/226,266, filed on Apr. 9, 2021, now Pat. No. 11,281,154.

(60) Provisional application No. 63/009,239, filed on Apr. 13, 2020.

(51) Int. Cl.
*G03G 21/16* (2006.01)
*G03G 15/00* (2006.01)

(52) U.S. Cl.
CPC ..... *G03G 21/1647* (2013.01); *G03G 15/657* (2013.01); *G03G 21/1685* (2013.01)

(58) Field of Classification Search
CPC ..... G03G 15/2017; G03G 15/657; G03G 21/1647; G03G 21/1661; G03G 21/1685
See application file for complete search history.

(56) References Cited

U.S. PATENT DOCUMENTS 6,240,265 B1 * 5/2001 Noh ..... G03G 15/2017 399/92
2019/0107806 A1 * 4/2019 Johnson, Jr. ..... G03G 21/1685

* cited by examiner

*Primary Examiner* — Sophia S Chen

(57) ABSTRACT

An imaging device has a fuser assembly and a removably insertable cartridge with an activation device. The fuser assembly has a fusing nip that heats during use. A shutter moves between a fully opened and fully closed position to allow or block access to the fusing nip. A frame has an opening to allow passage of the activation device of the cartridge. During use, the shutter blocks access to the fusing nip until the activation device of the cartridge passes through the opening of the frame and contacts a corresponding activation surface, whereby the shutter begins opening and travels through a range of movement until reaching the fully opened position when the cartridge is fully inserted into the imaging device. Removal of the cartridge reverses the action of the shutter.

20 Claims, 9 Drawing Sheets

SHUTTER FOR IMAGING DEVICE FUSER ASSEMBLY TRIGGERED BY CARTRIDGE

This application claims priority as a continuation application of U.S. Ser. No. 17/226,266, filed Apr. 9, 2021, having the same title.

FIELD OF THE INVENTION

The present disclosure relates to a fuser assembly in an imaging device. A shutter allows or blocks access to a fusing nip of the assembly that heats during use. Insertion or removal of a cartridge activates movement of the shutter.

BACKGROUND

In the electrophotographic (EP) imaging process in imaging devices (e.g., printers, copiers, all-in-ones, and the like), a photosensitive drum or belt is uniformly charged over an outer surface. An electrostatic latent image is formed by selectively discharging the surface and applying toner. The toner is transferred to media and fixed by applying heat and pressure in a fusing nip of a fuser assembly. Shutters block access to fusing nips to prevent users from contacting them.

Typically, activation of shutters occurs upon user manipulation of an access door of imaging devices. Such, however, requires mechanical linkage between shutters and doors, which limits spacing in the imaging device and dictates placement and orientation of fuser assemblies. Other imaging devices include electrical relays in their power supplies to cut power to the fusing nip upon opening of access doors. Yet, relays add cost and bulk. The inventor recognizes a need to overcome the foregoing problems, especially when contemplating more compact and less expensive imaging devices for consumers.

SUMMARY

An imaging device has a fuser assembly and a removably insertable cartridge with an activation device. The fuser assembly has a fusing nip that heats during use. A shutter moves between a fully opened and fully closed position to allow or block access to the fusing nip. A frame has an opening to allow passage of the activation device of the cartridge. During use, the shutter blocks access to the fusing nip until the activation device of the cartridge passes through the opening of the frame and contacts a corresponding activation surface. The shutter begins opening and travels through a range of movement until reaching the fully opened position when the cartridge is fully inserted into the imaging device. Removal of the cartridge reverses the action thereby closing the shutter.

DETAILED DESCRIPTION OF THE EMBODIMENTS

Figure 1:
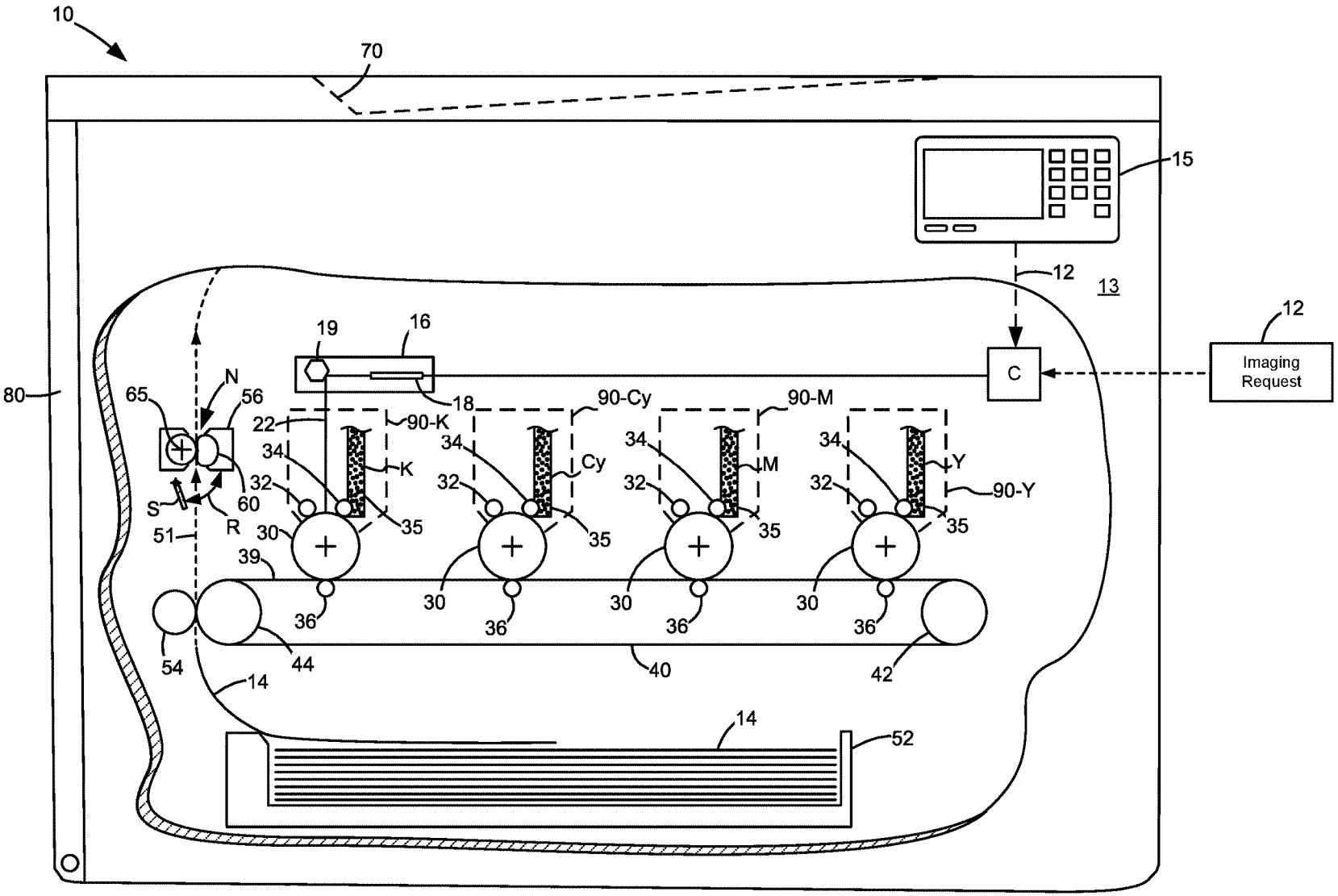
FIG. 1 is a diagrammatic view of the electrophotographic process in an imaging device having a fusing assembly with a fusing nip and a removably insertable cartridge.

FIG. 1 teaches an imaging device 10 that receives at a controller (C) a request 12 for imaging media 14. The request comes externally to a housing 13 of the imaging device, such as from a computer, laptop, smart phone, fax machine, server, cloud connection, etc. It also comes internally, such as from a user interface 15. In any, the controller converts the request to appropriate signals for providing to a laser scan unit 16. The unit turns on and off a laser 18 according to pixels of the imaging request. A rotating mirror 19 and associated lenses, reflectors, etc. (not shown) focus a laser beam 22 onto one or more photoconductive drums 30, as is familiar. The drums correspond to supplies of toner, such as black (K) and one or more colored toners, such as cyan (Cy), magenta (M) and yellow (Y). A corona or charge roller 32 sets a charge on a surface of the drums 30 as the drums rotate. The laser beam 22 electrostatically discharges the drums to create an electrostatic latent image. A developer roller 34 introduces toner to the latent image and the toner is electrostatically attracted to create a toned image on a surface of the drums. A voltage differential between the surface of the drums 30 and transfer rolls 36 causes transfer of the toned image from the drums to a surface 39 of an intermediate transfer member (ITM) 40.

The ITM 40, entrained about a drive roll 42 and one or more idler/tension rolls 44, moves in a process direction with the surface of the drums. A sheet of media 14 advances in a path of media travel 51 from a tray 52 to a transfer roll 54 where a second difference in voltage between the ITM and the transfer roll 54 causes the toned image to attract and transfer to a surface of the media 14. A fuser assembly 56 fixes the toned image to the media through application of heat and pressure in a fusing nip (N) formed by a heated member 60 and a backup member 65. Users pick up the media from a bin 70 after it advances out of the imaging device. The controller coordinates the operational conditions that facilitate the timing of the image transfer and transportation of the media from tray to bin.

Also, a door 80 connects to the imaging device to allow access to an interior of the housing 13. Users open the door to clear paper jams in the fusing nip or path of media travel, for example, or undertake maintenance on components of the imaging device, such as the fuser assembly 56. This or another door also allows users access to the interior of the imaging device to replace customer replaceable units, such as imaging cartridges 90-K, 90-Cy, 90-M, 90-Y. The imaging cartridges typify a single unit construction housing the toner, the rolls 32, 34, and the drum 30. Alternatively, the cartridges 90 are bifurcated such that the toner defines a single component of the cartridge holding only the toner, e.g., sleeve 35, and a second component holding the rolls, drum and other mechanical interfaces, whereby the two components connect to one another as is known. In either embodiment, the cartridges 90 can be used to trigger access to the fusing nip of the fuser assembly. When the cartridges are inserted into the imaging device, the cartridges block user-access to the fusing nip N and a shutter S resides in a fully opened position to allow a path of travel of the media 14 to the fusing nip N so that toner on the media can become fused during use. When the cartridges are removed, the shutter moves to block access to the fusing nip to prevent users from contacting the fusing nip, which is typically hot and maybe electrically charged. The shutter rotates from a fully opened to a fully closed position, and vice versa, along the path R, but other forms of movement of the shutter are possible.

Figure 2A:
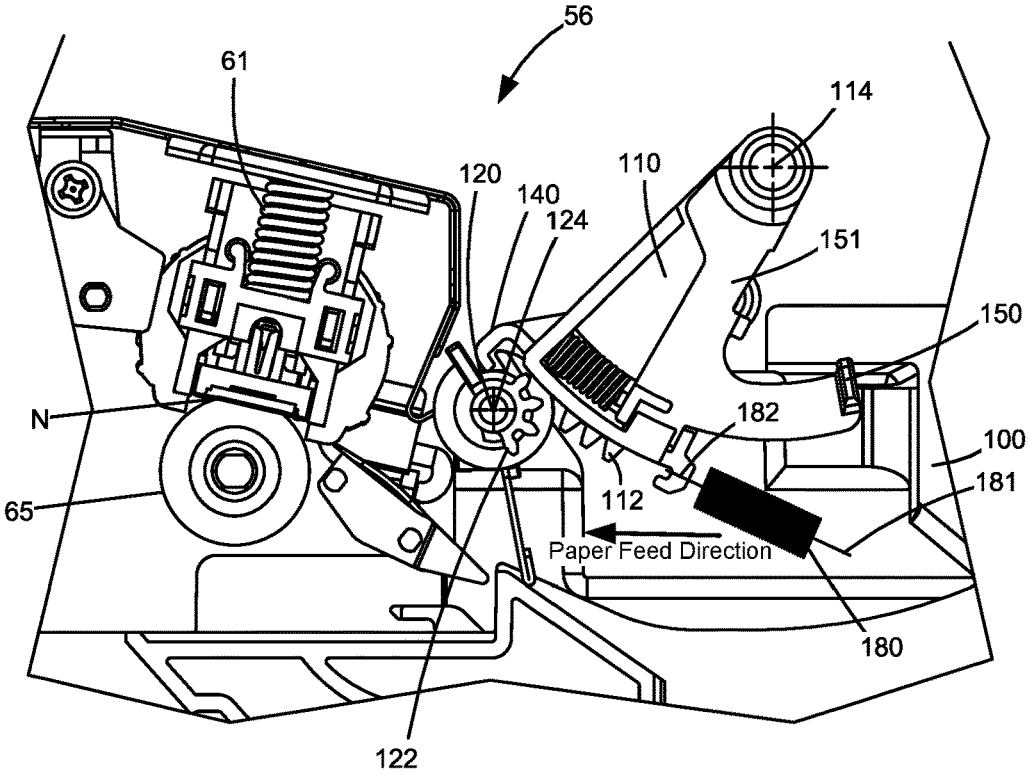
FIGS. 2A and 2B are partial diagrammatic, side views of a gearing assembly positioned without a cartridge inserted into an imaging device, resultingly a shutter resides in a fully closed position blocking access to a fusing nip.
Figure 2B:
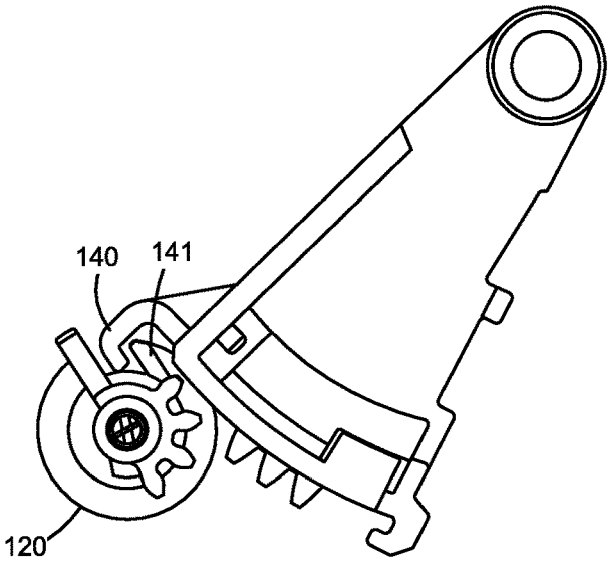
Figure 3A:
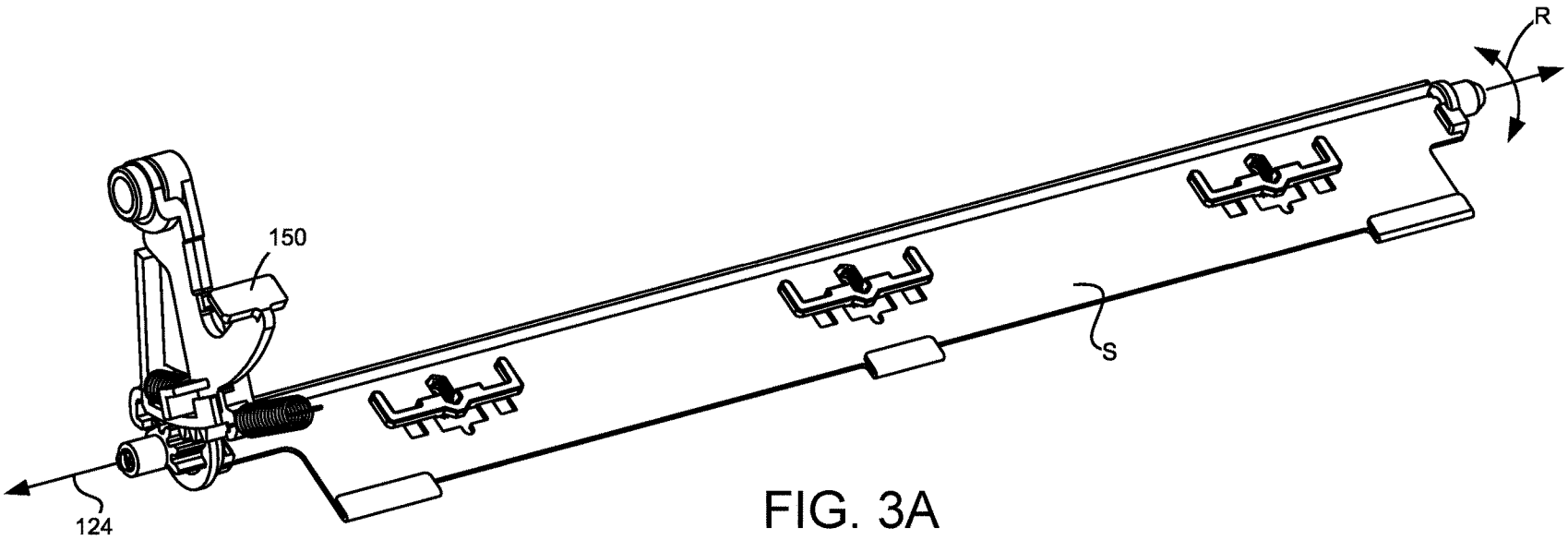
FIG. 3A is a partial diagrammatic, perspective view of a shutter and activation system therefor.
Figure 3B:
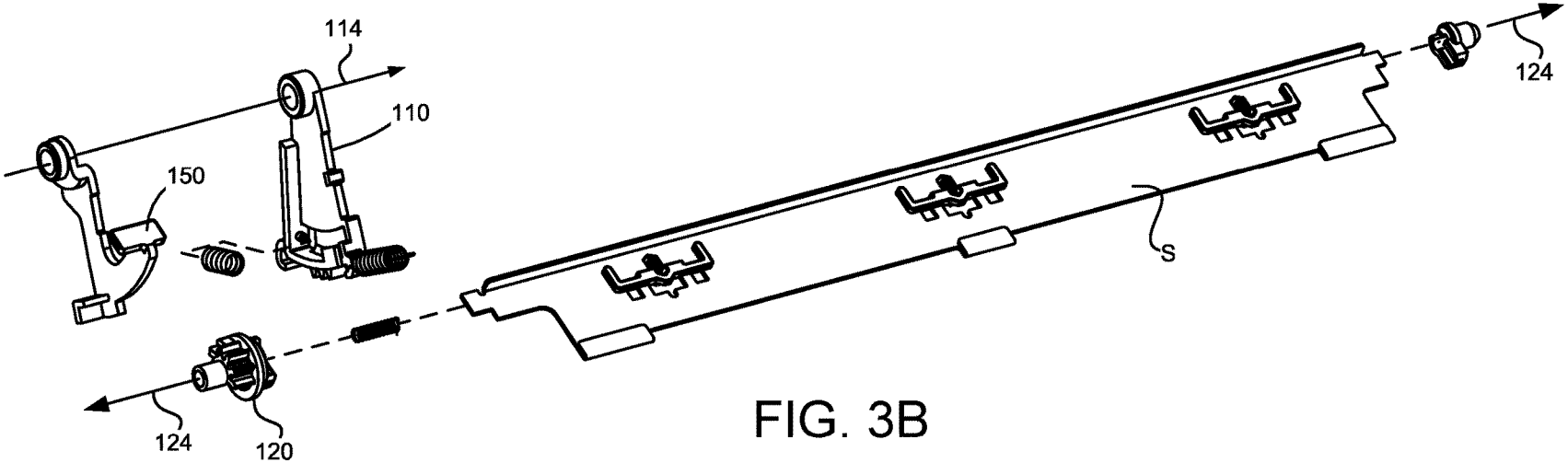
FIG. 3B is an exploded view of FIG. 3A.

With reference to FIG. 2A, the fusing nip N notes the backup member 65 and various components, e.g., spring 61, to keep in contact the heated member and the backup member. During use, the media travels to the nip along the direction of the arrow labeled paper feed direction. A frame 100 defines a reference for locating components that maneuver the shutter to allow or block access to the fusing nip during use. With further reference to FIGS. 3A and 3B, the frame 100 supports a gearing assembly including a shutter gear 110 and shutter pivot 120, each having gearing teeth 112, 122 that engage one another upon movement of the gearing assembly. The shutter gear 110 rotates about a pivot axis 114 while the shutter pivot rotates about an axis 124 corresponding to an axis of rotation of the shutter S. The shutter S extends longitudinally along a length of the fusing nip N transverse to the paper feed direction. The shutter S rotates R about the axis 124 from a fully opened position (FIG. 4A, with cartridge removed to illustrate positioning of the shutter) to a fully closed position (FIG. 4B) and all degrees of movement therebetween. In one embodiment, the shutter moves about 72 degrees between both positions. In the fully closed position, a tang 140 (FIGS. 2A, 2B), which connects to the shutter gear, engages the teeth of the shutter pivot or a lock feature 141 to keep the shutter from moving. In the fully opened position, the tang (FIGS. 6A and 6B) is moved out of the way of engagement with the shutter pivot 120.

Figure 5A:
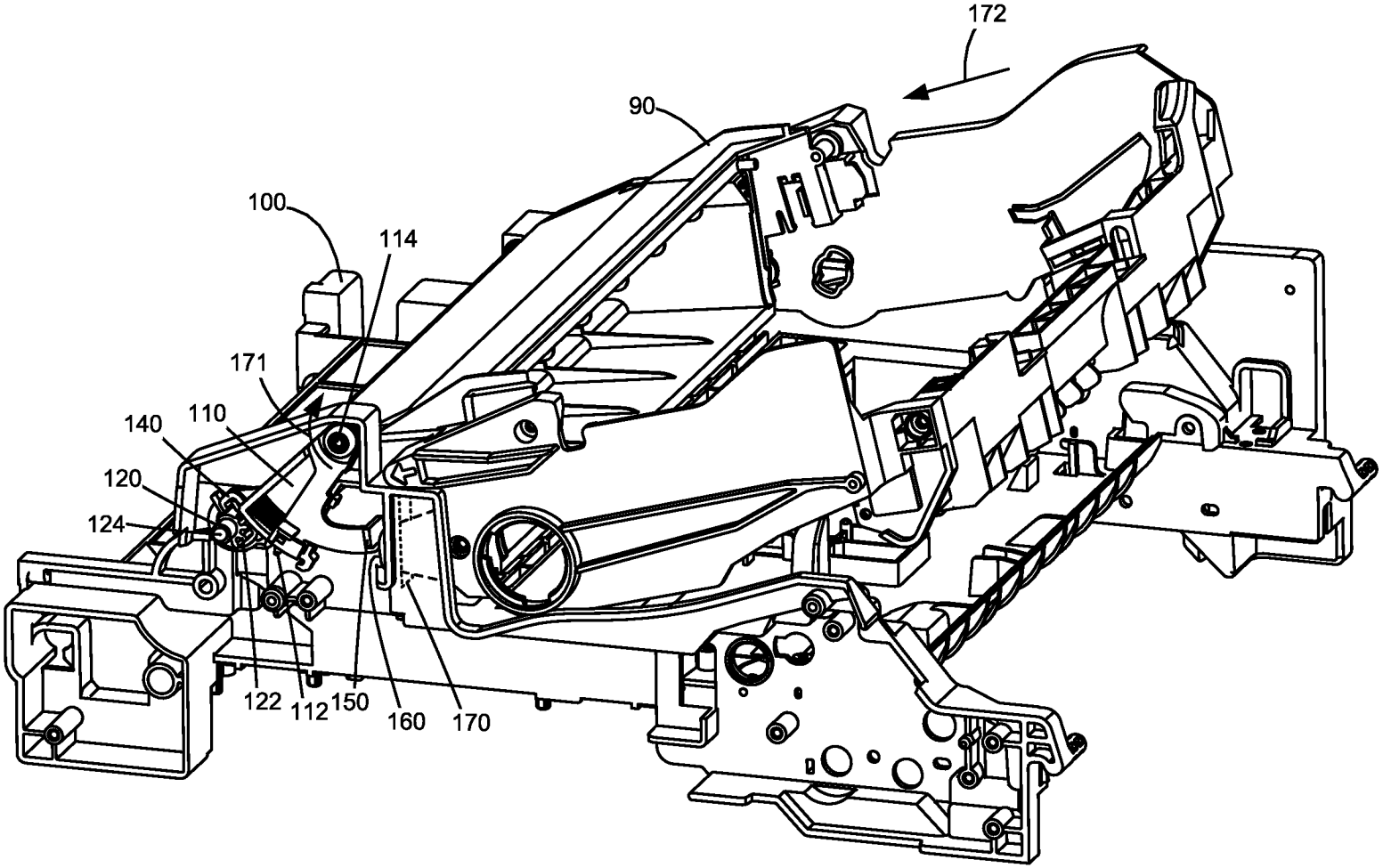
FIGS. 5A, 5B, and 5C are partial perspective views showing sequential movement of a gearing assembly upon cartridge insertion into a frame.

To move the tang in and out of engagement with the shutter pivot, the shutter gear 110 further connects to an activation surface 150. The activation surface can take many forms, but in one embodiment typifies a flat surface of a lever as shown. It can be also a divot, a projection, a crank, an arm, a plunger, a switch, or similar mechanical or electrical/mechanical device imparting movement upon activation. In any, the activation surface becomes acted upon by a corresponding activation device on the cartridge 90. As best seen in FIG. 5A, the activation device 160 is a tab. The tab fits through a slot 170 in the frame 100, the slot being sized and shaped to match the physical dimensions of the tab, but slightly larger to allow the tab to pass freely when the cartridge is inserted properly into the frame 100. The slot is also generally sized to prevent a user from accessing the activation surface. In other embodiments, the activation device could be a projection, a crank, an arm, a plunger, or any other similar mechanical or electrical/mechanical device working in coordination with the activation surface to impart movement to the gearing assembly.

Figure 4A:
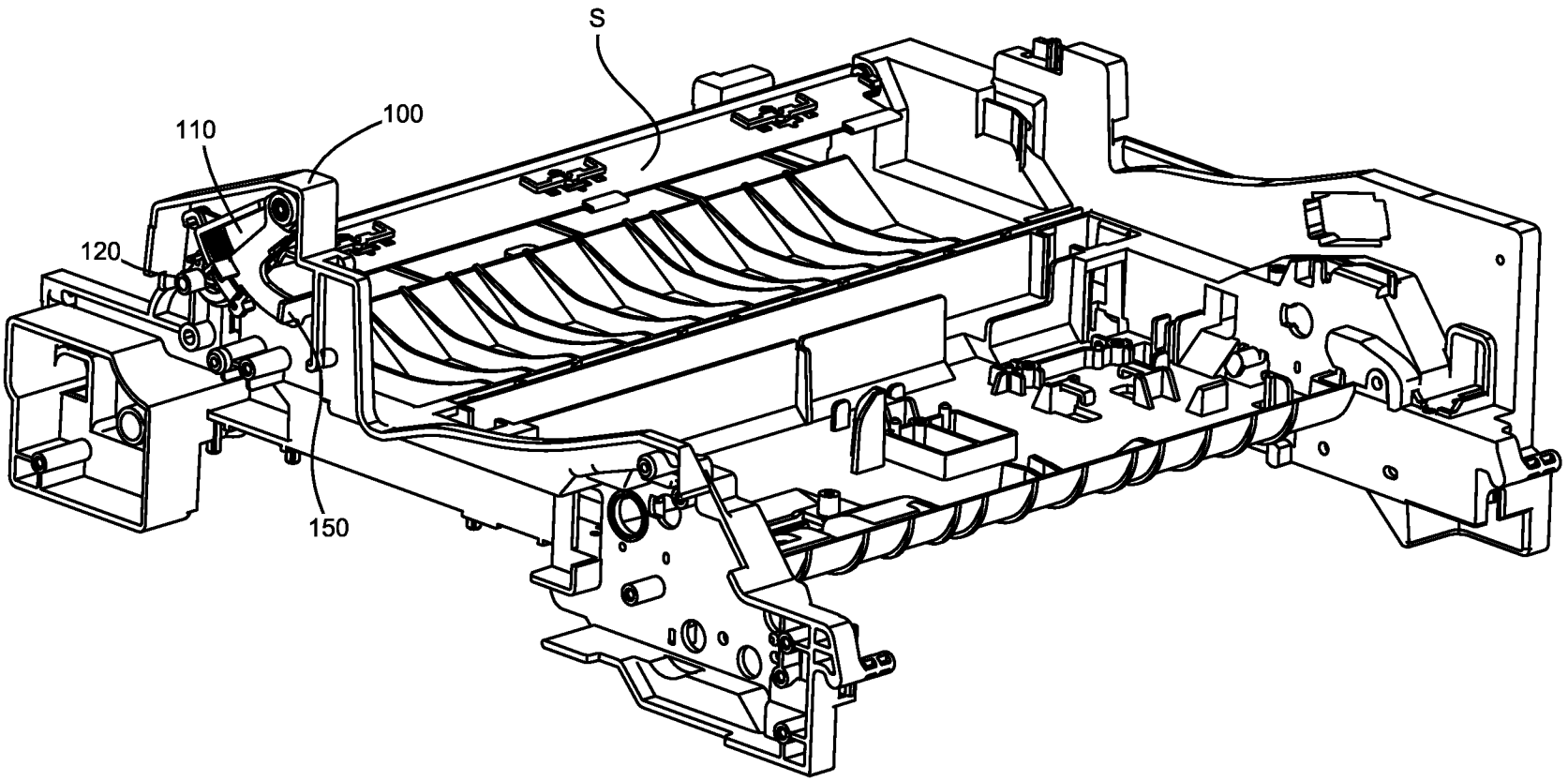
FIG. 4A is a partial perspective view of a frame including the shutter and activation system of FIG. 3A, the shutter residing in a fully opened position.
Figure 4B:
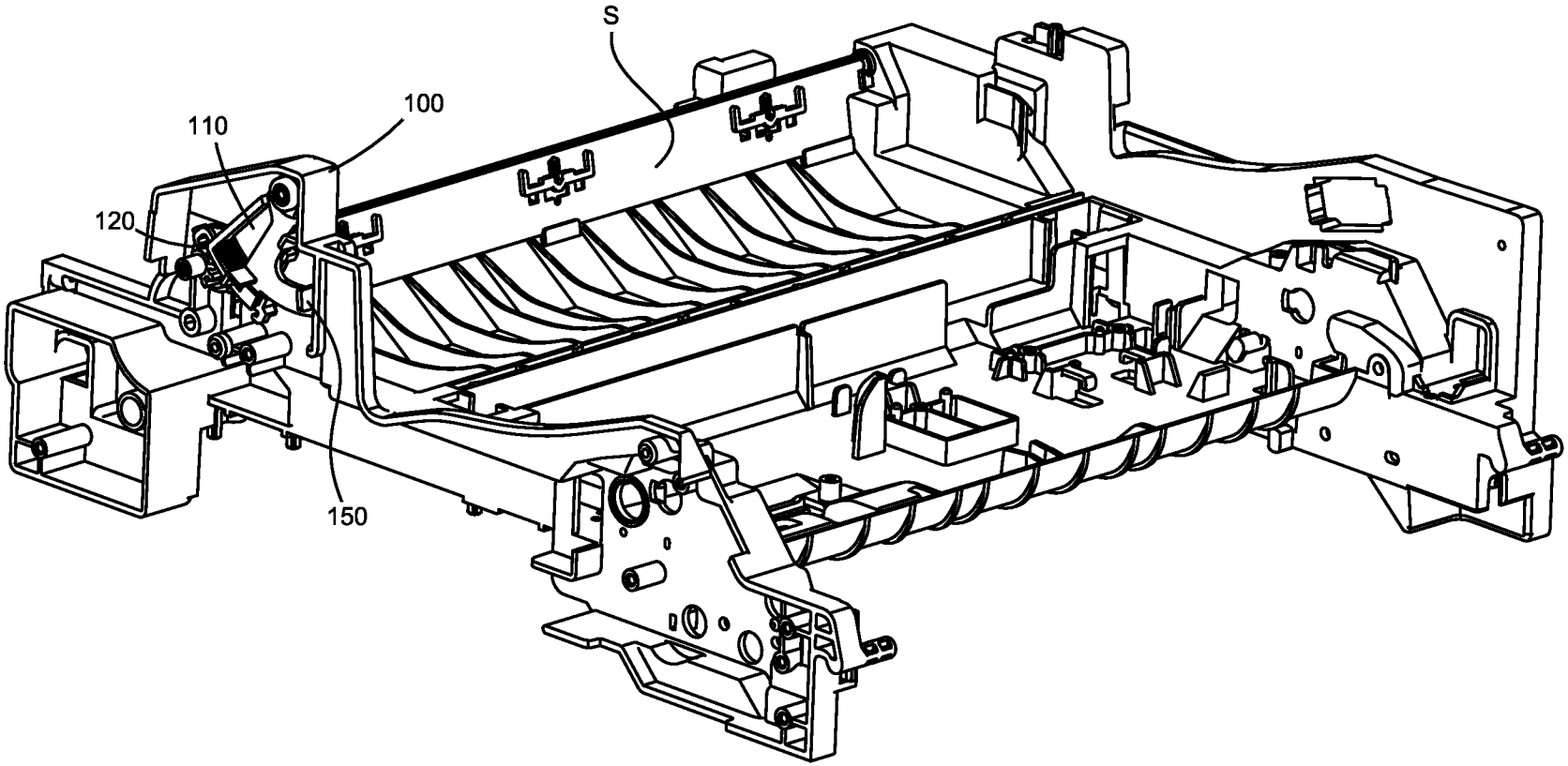
FIG. 4B is a partial perspective view of a frame including the shutter and activation system of FIG. 3A, the shutter residing in a fully closed position.
Figure 5B:
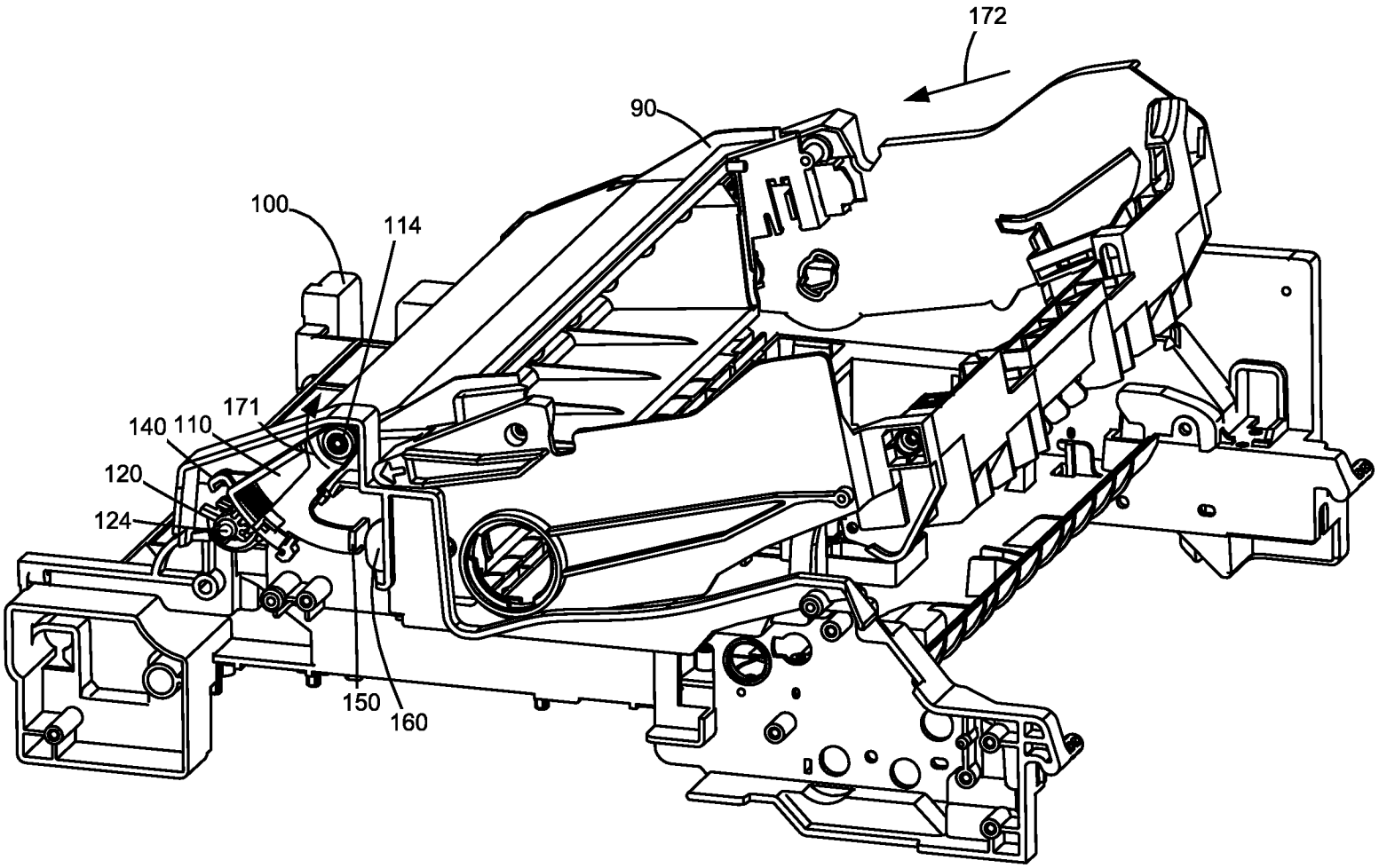
Figure 5C:
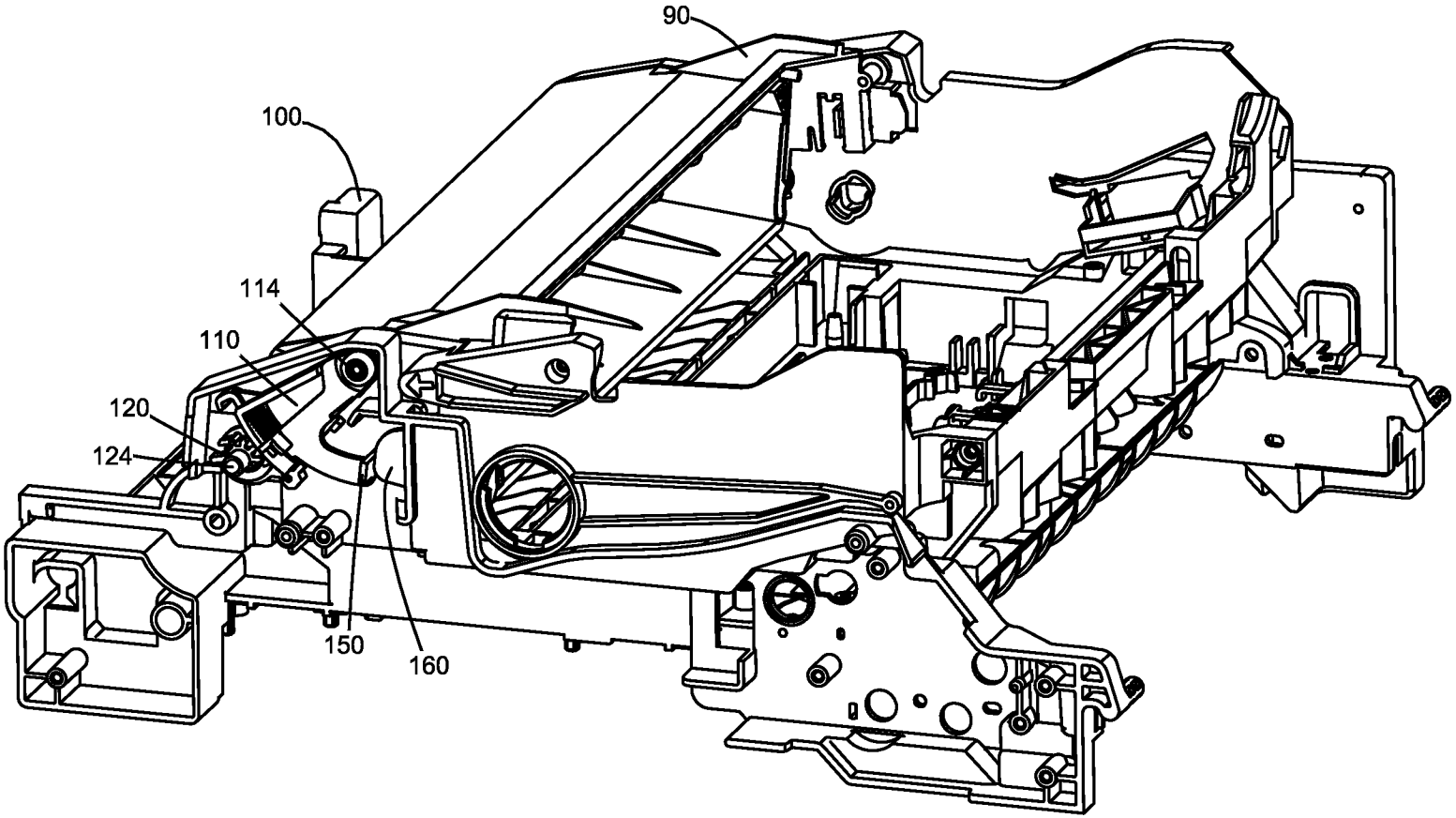

With reference to FIGS. 5A-5C, sequential movement of the shutter occurs according to sequential movement of the gearing assembly as the activation device of the cartridge acts upon the activation surface of the shutter gear, in turn, upon the gearing assembly. As noted in FIG. 5A, as the cartridge 90 is initially inserted into the frame 100, the shutter S (FIG. 4B) remains in the fully closed position, until the activation surface 160 passes through the slot 170 and contacts the activation device 150. In turn, the activation surface starts rotation 171 of the shutter gear 110 about the pivot axis 114 (clockwise in this view). In further turn, the teeth 112 of the shutter gear mesh with the teeth 122 of the shutter pivot which rotates the tang 140 out of engagement with the shutter pivot. This action causes initial movement of the shutter S from its fully closed position. In FIG. 5B, further insertion of the cartridge 90 along direction of an arrow 172 into the frame 100 causes the activation device 160 to push further through the slot of the frame and rotate further the activation surface 150 and shutter gear 110 about the pivot axis 114. The meshing teeth 112, 122, of the shutter gear and shutter pivot cause further movement of the shutter S toward a fully opened position. The insertion of the cartridge by a user continues until such time as the cartridge 90 is fully seated and inserted into the frame 100, as in FIG. 5C. As noted in FIG. 4A, this causes the shutter to reside in the fully opened position (but FIG. 4A is shown without reference to the cartridge 90 as the cartridge actually appears in FIG. 5C blocking the visual representation of the shutter). It should be noted that during insertion of the cartridge from initial contact of the activation surface until the cartridge being fully inserted into the frame, the tang 140 first impedes movement (rotation) of the shutter pivot 120 until the cartridge is inserted far enough to free the tang from blocking rotation of the shutter pivot. Conversely, removal of the cartridge causes movement in the reverse until the tang eventually blocks movement of the pivot. Skilled artisans will note there exists a gear ratio of about 8:1 between the shutter gear and the shutter pivot which allows the shutter to move about 72 degrees from the fully opened to the fully closed position with only about 9 degrees of corresponding movement of the shutter gear. Of course, other ratios are possible as are degrees of shutter movement.

Figure 6A:
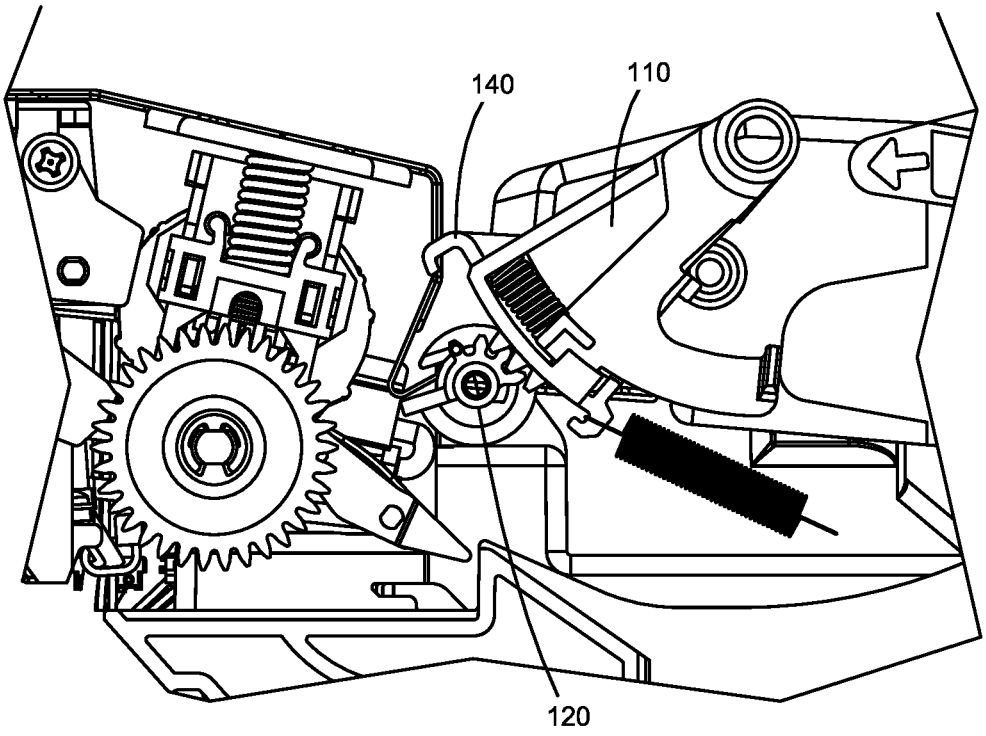
FIGS. 6A and 6B are partial diagrammatic, side views of a gearing assembly positioned with a cartridge being fully inserted into an imaging device, resultingly a shutter resides in a fully opened position allowing passage of media through a fusing nip.
Figure 6B:
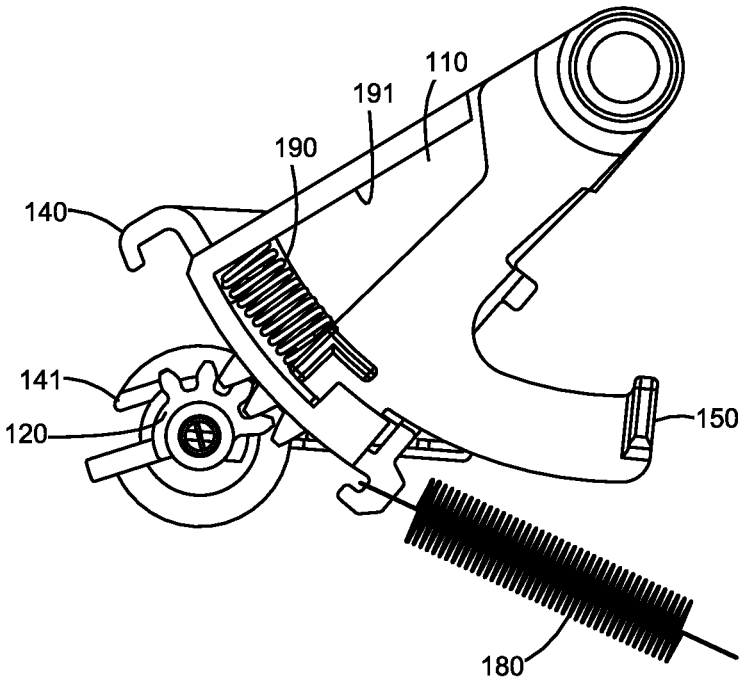

As best seen in FIGS. 2A, 6A and 6B, a spring 180 biases the activation surface 150 toward the slot 170 of the frame. The spring on one end 181 attaches to the frame, while the other end 182 attaches to the shutter gear. Alternatively, the spring attaches directly to the activation surface, or elsewhere, to keep under tension the activation surface in a direction toward the activation device of the cartridge. At 190, a second spring exists between the activation surface 150 and a surface 191 of the shutter gear to compensate for variations in parts from the manufacturing process. That is, the activation surface is formed as a molded piece 151 separate from the shutter gear 100 and both attach at the pivot axis 114 and rotate in unison, thereabout. Alternatively, the shutter gear and the activation surface are a singular part, such as from being singularly molded. Similarly, the shutter is comprised of injection molded parts from multiple cavity tools and the possibility for part size variation exists and tolerances can stack up between all related pieces. Thus, the spring 190 is provided to ensure the shutter remains in its intended position. The shutter and lock features are also designed so that the spring 190 compresses slightly at the fully opened position of the shutter, thereby allowing the activation surface to travel +/−2 degrees although only 9 degrees movement is needed to move the shutter 72 degrees of movement based on the 8:1 gear ratio.

In any embodiment, the fuser shutter described herein is designed to prevent user access to the fusing nip of a fuser assembly in which the heated member becomes exceptionally hot during use and can, in rare instances, become electrically charged. The shutter is designed to be operated upon insertion of the cartridge, especially an activation device that contacts an activation surface interconnected with the shutter. The shutter to date has been designed to pass the Underwriters Laboratories (U.L.) child-finger safety test, in which 30N of force is applied to the shutter and users are prevented contact with the fusing nip, heated member, and backup member and fingers of users are not allowed to actuate any mechanism that opens the shutter. Also, if a user attempts to circumvent or defeat the mechanism by rotating the shutter from inside the imaging device, the tang engages the teeth or the lock feature preventing the shutter from rotating upward toward the opened position.

The foregoing illustrates various aspects of the invention. It is not intended to be exhaustive. Rather, it is chosen to provide the best mode of the principles of operation and practical application known to the inventor so one skilled in the art can practice it without undue experimentation. All modifications and variations are contemplated within the scope of the invention as determined by the appended claims. Relatively apparent modifications include combining one or more features of one embodiment with those of other embodiments. Sill other modifications include imaging device configurations transferring toned images direct to media from the photoconductive drum instead of indirectly via an ITM as noted in FIG. 1.

The invention claimed is:

1. An imaging device, comprising:

a removably insertable toner cartridge having an activation device;

a fuser assembly having a fusing nip that heats during use to fuse toner from the toner cartridge to media passing through the fusing nip; and a frame to support the removal and insertion of the toner cartridge, the frame having an opening to allow passage of the activation device of the toner cartridge, the frame also supporting a shutter to open or block access to the fusing nip; and an activation surface, wherein the shutter blocks access to the fusing nip until the activation device of the cartridge passes through the frame and contacts the activation surface thereby beginning opening of the shutter and allowing opening through a range of movement until fully opened when the cartridge is fully inserted into the frame.

2. The imaging device of claim 1, wherein the activation surface attaches to a shutter gear rotatable about a pivot axis.

3. The imaging device of claim 2, wherein the shutter gear connects to a tang.

4. The imaging device of claim 3, further including a shutter pivot rotatable about an axis corresponding to an axis of rotation of the shutter, the tang impeding movement of the shutter pivot until the activation surface of the shutter gear causes rotation of the shutter gear about the pivot axis.

5. The imaging device of claim 4, wherein there exists a gear ratio of about 8:1 between the shutter gear and the shutter pivot allowing the shutter to move from a fully closed position blocking access to the fusing nip to a fully opened position allowing media to pass unimpeded through the fusing nip during use.

6. The imaging device of claim 5, wherein the gear ratio allows the shutter to move 72 degrees from the fully closed position to the fully opened position.

7. The imaging device of claim 4, wherein the frame defines the axis of rotation of the shutter.

8. The imaging device of claim 2, wherein the frame defines the pivot axis of the shutter gear.

9. The imaging device of claim 1, wherein the opening in the frame is a slot sized and shaped to accept passage of a tab defining the activation device of the cartridge.

10. The imaging device of claim 1, further including a spring to bias the activation surface toward the opening of the frame.

11. The imaging device of claim 10, wherein one end of the spring attaches to the frame while the other end of the spring attaches to a gear connected to the shutter.

12. An imaging device, comprising:

a removably insertable toner cartridge having a tab;

a fuser assembly having a fusing nip that heats during use to fuse toner from the toner cartridge to media passing through the fusing nip; and a frame to support the removal and insertion of the toner cartridge, the frame having a slot to allow passage of the tab of the toner cartridge, the frame also supporting a shutter to open or block access to the fusing nip; and a lever connected to the shutter for being contacted by the tab of the cartridge upon insertion of the cartridge into the frame, wherein the shutter blocks access to the fusing nip until the tab of the cartridge passes through the slot of the frame and contacts the lever thereby beginning opening of the shutter and allowing opening through a range of movement until fully opened when the cartridge is fully inserted into the frame.

13. The imaging device of claim 12, wherein the frame defines a pivot axis of a shutter gear connected to the frame, wherein the lever attaches to the shutter gear.

14. The imaging device of claim 13, wherein the frame connects to a shutter pivot rotatable about an axis corresponding to an axis of rotation of the shutter.

15. The imaging device of claim 14, further including a tang connected to the shutter gear, the tang impeding movement of the shutter pivot until the lever of the shutter gear causes rotation of the shutter gear about the pivot axis.

16. The imaging device of claim 14, wherein there exists a gear ratio of about 8:1 between the shutter gear and the shutter pivot allowing the shutter to move from a fully closed position blocking access to the fusing nip to a fully opened position allowing the media to pass unimpeded through the fusing nip during use.

17. The imaging device of claim 12, wherein the shutter moves about 72 degrees from a fully opened position to a fully closed position blocking access to the fusing nip.

18. The imaging device of claim 12, further including a spring to bias the lever toward the slot of the frame.

19. The imaging device of claim 18, wherein one end of the spring attaches to the frame.

20. The imaging device of claim 12, wherein the shutter moves from the fully opened to a fully closed position blocking access to the fusing nip with only 9+/−2 degrees of movement of the lever.

* * * * *